United States Patent [19]

Stahlecker

[11] Patent Number: 4,627,230

[45] Date of Patent: Dec. 9, 1986

[54] OPEN-END FRICTION SPINNING MACHINE

[75] Inventor: Fritz Stahlecker, Josef-Neidhart-Strasse 18, 7347 Bad Uberkingen, Fed. Rep. of Germany

[73] Assignees: Hans Stahlecker; Fritz Stahlecker, both of Fed. Rep. of Germany

[21] Appl. No.: 731,263

[22] Filed: May 7, 1985

[30] Foreign Application Priority Data

May 8, 1984 [DE] Fed. Rep. of Germany ..... 3416886

[51] Int. Cl.[4] ..... D01H 15/00; D01H 13/16

[52] U.S. Cl. ..... 57/401; 57/81; 57/264

[58] Field of Search ..... 57/264, 300, 301, 400, 57/401, 81, 78, 80, 261, 263

[56] References Cited

U.S. PATENT DOCUMENTS

| | | | |
|---|---|---|---|
| 4,084,398 | 4/1978 | Stahlecker et al. | 57/81 X |
| 4,137,699 | 2/1979 | Stahlecker et al. | 57/81 X |
| 4,168,601 | 9/1979 | Didek et al. | 57/401 |
| 4,222,222 | 9/1980 | Didek et al. | 57/401 |

*Primary Examiner*—Donald Watkins

*Attorney, Agent, or Firm*—Barnes & Thornburg

[57] ABSTRACT

An open-end friction spinning machine having a plurality of spinning units, each having two rollers that are arranged next to one another and form a wedge-shaped yarn-forming gap is provided with a yarn guard for sensing yarn breakage in each spinning unit. In response to yarn breakage sensed by an individual yarn guard of a spinning unit, a wind-up spool is lifted off its driving roller and the rollers are stopped. Preferably, a control element is provided for lifting-off of the wind-up spool, and at the same time triggering the stoppage of the rollers and/or switching-off of a suction device arranged adjacent the wedge-shaped yarn-forming gap.

26 Claims, 5 Drawing Figures

OPEN-END FRICTION SPINNING MACHINE

BACKGROUND AND SUMMARY OF THE INVENTION

This invention relates to an open-end friction spinning machine having a plurality of spinning units, each containing two rollers that are arranged next to one another, form a wedge-shaped gap for the formation of yarn and are driven in the same rotational direction. Each spinning unit also contains a feeding device for fiber material to be spun that can be switched off via a yarn guard in the case of a yarn breakage, as well as an opening device, a suction device aimed into the wedge-shaped gap for the holding of the fiber material and of the yarn in the wedge-shaped gap, a withdrawal device withdrawing the spun yarn from the wedge-shaped gap, and a wind-up device winding the withdrawn yarn onto a wind-up spool that can be lifted off the driving roller.

In the case of an open-end friction spinning machine having one single spinning unit (EP-OS No. 34 427), it is known to switch off the device for the feeding of the fiber material in the case of a yarn breakage, while all other elements, especially the rollers and the wind-up spool continue to be driven. In the case of a yarn breakage, it may frequently happen that fibers or yarn residue or similar substances are located in the area of the wedge-shaped gap which will then continue to be twisted together by the rollers without being withdrawn from the area of the wedge-shaped gap. The result will then be a very hard twisted yarn-type structure which may lead to the danger of damage occurring at the rollers and/or their bearings, for example, by means of a deformation of the shell surfaces of the rollers. In addition, there is the danger that the continuously driven wind-up spool will be impaired with respect to its quality because the same layers of yarn will rotate on the driving roller and be pressed into the other layers of yarn. It will then also be difficult to find the broken yarn end required for the piecing process.

One objective of the present invention is the provision of an open-end friction spinning machine of the initially mentioned type such that after a yarn breakage, danger of damage to the rollers and/or their bearings will not exist and the wind-up spool itself will not be damaged.

This objective is achieved by equipping each spinning unit with means for lifting the wind-up spool off its driving roller and with means for interrupting the drive of the rollers. These means are controlled by the yarn guard of the spinning unit.

Thus it is provided that, in addition to an interruption of the feeding device for the fiber material, the rollers are stopped and the wind-up spool is lifted off the driving roller. Fiber residues are no longer twisted together in the wedge-shaped gap and cannot cause damage there. By means of the lifting of the wind-up tool, the outer layers of yarn are not pressed into the other layers of yarn so that there will be no damage to the wind-up spool and so that the broken yarn end is relatively easy to find.

In an advantageous development of the invention, it is provided that each spinning unit is equipped with means for interrupting or reducing the suction effect of the suction device which are controlled by the yarn guard. Remaining fibers or similar objects that may still be located in the wedge-shaped gap, will no longer be drawn into the wedge-shaped gap by means of the suction device so that they can be removed relatively easily.

In a first embodiment, it is provided that the yarn guard of each spinning unit is connected directly to the means for lifting off the wind-up spool, the means for interrupting the drive of the rollers and/or the means for interrupting or reducing the suction effect of the suction device. As a result, these functions are all triggered simultaneously by the yarn guard. In the case of a further development of the invention, it is provided that each spinning unit contains a control device to which the yarn guard is connected and which itself is connected with the means for lifting off the wind-up spool, the means for interrupting the drive of the rollers and/or the means for interrupting or reducing the suction effect of the suction device. This makes it possible, via the control device triggered by the signal of the yarn guard, to operate the individual means at indicated, coordinated points in time.

In another development of the invention, it is provided that the means for lifting off the wind-up spool are connected to the means for interrupting the drive of the rollers and/or the means for interrupting or reducing the suction effect of the suction device via a preferably mechanical connection. In this embodiment, the control movements are derived from only one control element and transmitted to all other elements. In a further development of this embodiment, it is provided that the mechanical connection has a locking device holding the means for interrupting the drive of the roller and/or for interrupting or reducing the suction effect of the suction device in the operating position against the effect of a biasing means.

In a further development of the invention, it is provided that the wind-up spools are held in spoolholders each of which is equipped with an actuating drive contanining a coupling to be closed during the operation. This ensures that the spoolholders can move during the spinning without being hindered, during which they are gradually lifted up corresponding to the diameter of the spools which increases during the spinning. The actuating drive, via the coupling, is connected with this spoolholder in such a way that always the same lifting movement is sufficient in order to still sufficiently lift the wind-up spool off the driving roller.

Further objects, features, and advantages of the present invention will become more apparent from the following description when taken with the accompanying drawings which show, for purposes of illustration only, embodiments in accordance with the present invention.

DETAILED DESCRIPTION OF THE DRAWINGS

Figure 1:
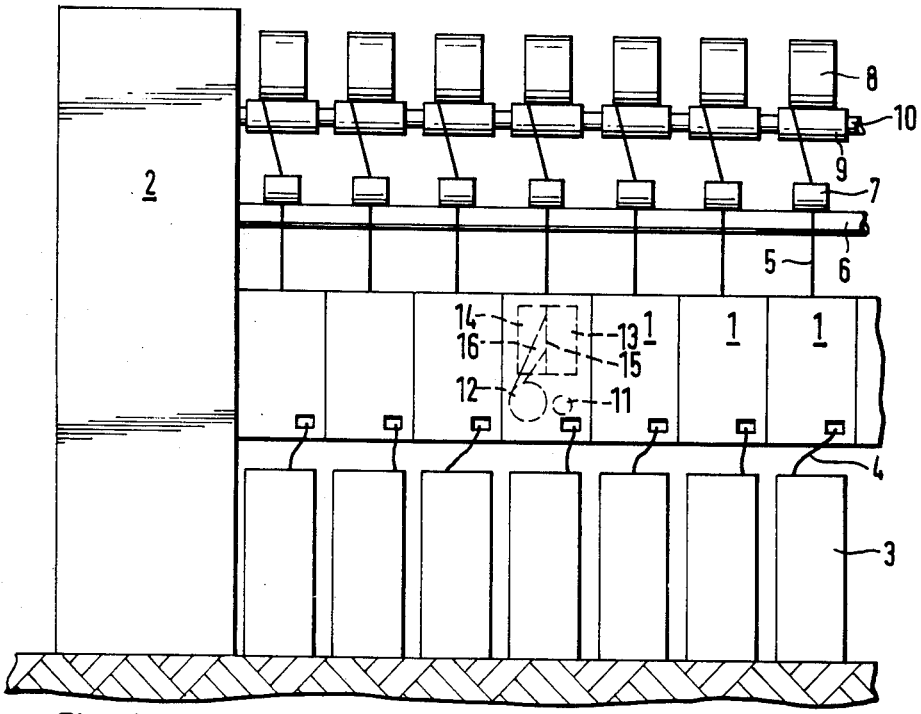
FIG. 1 is a front view of an open-end friction spinning machine.

The open-end friction spinning machine shown partially in FIG. 1 has a plurality of spinning units which are constructed identically and are arranged in a row adjacent one another. The front end of the open-end friction spinning machine is bounded by a driving head 2 and an opposite gearhead. A sliver 4 to be spun is fed to the individual spinning units 1 from a can 3. The spun yarn is withdrawn by means of a withdrawal device consisting of a driven bottom cylinder 6 extending through in longitudinal direction of the machine and a pressure roller 7 provided at each spinning unit 1. Subsequently, the yarn 5 at each spinning unit 1 is wound onto a wind-up spool 8 which in each case is driven by a grooved drum 9. The grooved drums 9 are arranged on a driven shaft 10 extending through in longitudinal direction of the machine. As shown in diagram form in FIG. 1, each spinning unit 1 has a feeding roller 11 pulling in the sliver 4, said feeding roller 11 interacting with a feeding table that is not shown. The feeding roller 11 offers the sliver 4 in the form of a fiberbeard to a more rapidly rotating opening roller 12 which combs the sliver 4 out into individual fibers which, via a fiber feeding duct 16, are fed to a wedge-shaped gap 15 between two rollers 13 and 14. The arrangement is such that the spun yarn 5 is withdrawn in longitudinal direction of the wedge-shaped gap 15.

Figure 2:
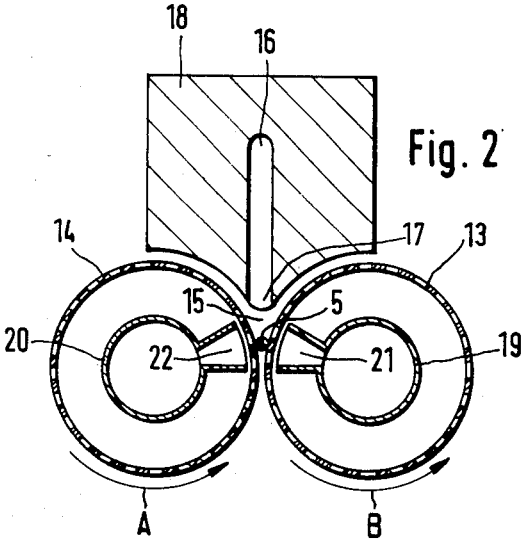
FIG. 2 is an enlarged partial section through a single spinning unit of the open-end friction spinning machine in the area of the rollers.

The fiber feeding duct 16 is housed in a housing part 18 and with its mouth 17 is aimed against the area of the wedge-shaped gap 15 (FIG. 2). The slot-shaped mouth 17 of the fiber feeding duct 16 extends essentially in parallel to the wedge-shaped gap 15 and at a slight distance from it. The rollers 13 and 14 which are driven in the same rotational direction indicated by Arrows A and B have perforated shell surfaces. On the inside of each of the rollers 13 and 14, a suction pipe 19 and 20 is arranged, which is connected to a vacuum source. The suction pipes in which the rollers are directly disposed are provided with suction slots 21 and 22 which are bounded by webs projecting up toward the interior surface of the shell surfaces of the rollers 13 and 14. The suction slots 21 and 22 are aimed at the area of the wedge-shaped gap 15. This generates an air current that is led through the shell surfaces of the rollers 13 and 14 and holds the forming yarn 5 in the area of the wedge-shaped gap 15 and also supports the fiber transport in the fiber feeding duct 16.

The suction pipes 19 and 20 on which the rollers 13 and 14 are directly disposed by means of roller bearings 23 and 24 (FIG. 3) are held in half-shell-shaped recesses of a roller housing 25 by means of tool holders 26 which are tightened by means of screws 27. The roller housing 25 is fastened at a support 28 by means of screws 29. The suction pipes 19 and 20 are closed at their ends facing the withdrawal device 6, 7 by means of plugs 30. The other ends project out of the rollers 13 and 14 by means of an elbow 31 and are connected to a joint valve 32. The valve 32 is solenoid valve.

The rollers 13 and 14, on the side opposite the withdrawal device 6, 7, project from the roller housing 25 by a distance 33 which is utilized for the direct drive of the rollers 13 and 14. A driving belt 34 is wound around the area 33 of the rollers 13 and 14, preferably in the area of the roller bearing 24 and around both rollers 13 and 14 simultaneously, said driving belt 34 being guided via a driving pulley 35 of an electric motor 36. In this case, the electric motor 36 is movably suspended in the direction away from the two rollers 13 and 14 and is optionally loaded by a spring in such a way that at the same time it serves as the tensioning device for the driving belt 34. The electric motor 36, via an electric line 37, is connected to a control unit 38 by means of which the speed of the electric motor 36 can be regulated.

The feeding roller 11 of the feeding and opening device arranged below the rollers 13 and 14 is disposed in a tube 39 held at the spinning unit 1 by holding means that are not shown in detail. The shaft of the feeding roller 11, at its end, is equipped with a toothed wheel 40 mating with a driving wheel 41. One driving wheel 41 is provided for each spinning unit 1. These driving wheels 41 are arranged on a joint driven shaft 42 extending through in longitudinal direction of the machine. The toothed wheel 40, via an electromagnetic clutch 43, is connected with the shaft 39 of the feeding roller 11.

The opening roller 12 is arranged in an opening roller housing 44 which toward the operating side is closed by a detachable cover 45. The opening roller housing 44 has a sleeve-type projection 46 by means of which it is fitted onto the tube 39 receiving the feeding roller 11. In axial direction, it supports itself under the effect of a spring that is not shown against a ring collar 47 of the tube 39. On the side facing away from the cover 45, the shaft 48 of the opening roller 12 projects out of the opening roller housing 44. It is driven there by a tangential belt 49 extending through in longitudinal direction of the machine and driving all opening rollers 12 of one side of the machine.

A first segment 50 of the fiber feeding duct 16 starts in the opening roller housing 44 tangentially at the circumference of the opening roller 12. The second segment 51 of the fiber feeding duct 16 is located in the mentioned housing part 18 having the mouth 17. The fiber feeding duct 16 extends in a straight line and is located essentially in the plane between the two rollers 13 and 14.

The wind-up spools 8 of each spinning unit 1 are held between two arms of a spool frame 52. The arms have two coaxial receiving means 53 that are opposite one another and between which the spools 8 are clamped. In this case, at least one of the arms can be moved in axial direction of the windup spool 8. The spool frame 52 is disposed so that it can be pivoted around a shaft 55 that is parallel to the shaft of the wind-up spool. At least one of the arms of the spool frame 52 is equipped with a handle 54 projecting toward the outside so that the spool frame 52 together with the wind-yup spool 8 can be lifted off the driving roller 9.

In the path of the yarn, between the end of the rollers 13 and 14 and the withdrawal device 6, 7, a yarn guard 56 is arranged containing an electric switch which responds in the case of a yarn breakage. The switch can register the presence of the yarn 5 by means of a tension sensor or possibly also without contact. The yarn guard 56 is fastened at the support 28 by means of a holder 57 and screws 58. The yarn guard 56, via an electric line 59, is connected with a three-way valve 60, via which a compressed-air inlet pipe 61 can be connected with an outlet pipe 62 or a compressed-air pipe 63 leading to a pneumatic control element 64. Via a line 65, having a branch 66, the yarn guard 56 is connected to the control unit 38. In addition, the yarn guard 56, via lines 67 and 68, is connected to the valve 32 and the clutch 43. In the case of a yarn breakage registered by the yarn guard 56, the three-way valve 60 is switched. In addition, the feeding roller 11 and the rollers 13 and 14 are stopped via a switching-off of the electric motor 36. In addition, the valve 32 is closed so that the suction device 19, 20 is switched off. Naturally, it is also possible to design the control device 38 in such a way that the signal of the yarn guard 56 is delivered to the control device 38 and said control device 38 correspondingly controls the three-way valve 60, the electric motor 36, the valve 32 and the clutch 43. The control device 38 must then be designed correspondingly and not be intended only for the control of the electric motor 36.

A pressure rod 69, via a joint 70, is linked to the spool frame 52, the other end of said pressure rod 69 being slidably guided in a stationary guide that is not shown in detail. The pressure rod 69 is led through the pneumatic control element 64 and, if said control element 64 is acted upon by compressed air, can be coupled with it. Otherwise, the pressure rod 69 is freely movable in the control element 64 so that, together with the spool frame 52, with an increasing diameter of the wind-up spool 8, it can move in the direction of the Arrow D.

The pneumatic control element 64 is a stationary ring piston 71 into which the compressed-air pipe 63 leads. A ring cylinder 72 is assigned to the ring piston 71, said ring cylinder 72, in the direction of the ring piston 71 being loaded by means of pressure springs 73. When compressed air is admitted to the ring-shaped space 74 between the ring piston 71 and the ring cylinder 72 by a corresponding switching of the three-way valve 60, the ring cylinder 72 is shifted against the pressure of the springs 73. The ring cylinder 72 surrounds the pressure rod 69 with a conical ring surface tapering against its moving-out direction, several balls 75 being arranged in the area between this ring surface 77 and the pressure rod 69. The ring surface 77 and the ball 75 form a coupling, in which case the balls 75 are braced with the ring surface 77 and the pressure rod 69 when the ring cylinder 72 is moved out so that the pressure rod 69 is taken along. Thus when compressed air is admitted to the control element 64, the pressure rod 69 is moved out so that the wind-up spool 8 is lifted off the driving roller 9.

Figure 3:
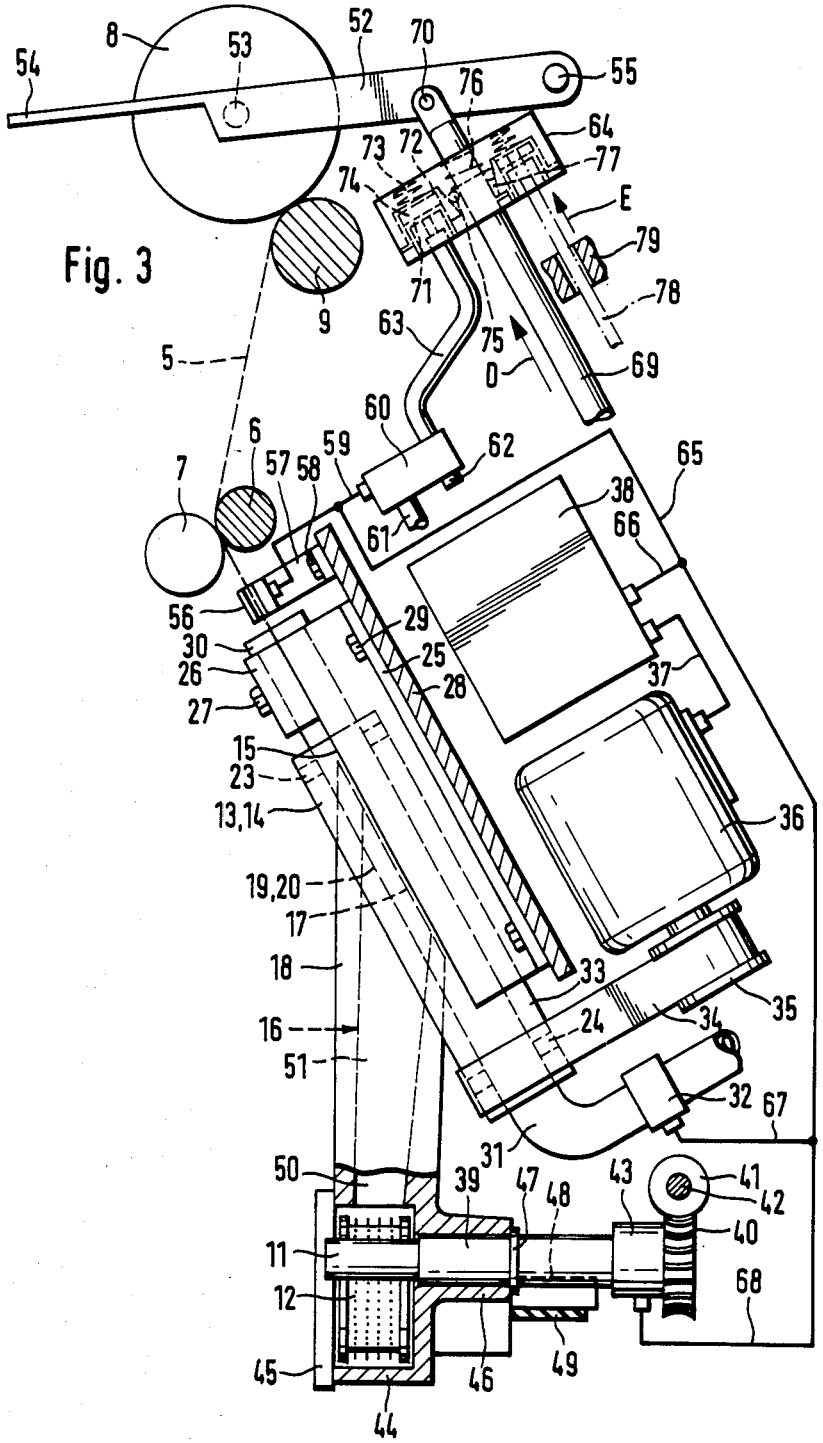
FIG. 3 is an enlarged vertical section of a single spinning unit of the open-end friction spinning machine.

As shown by a dash-dotted line in FIG. 3, a rod-shaped adjusting element 78 extending in parallel to the pressure rod 69 can be mounted at the ring cylinder 72, said adjusting element 78 being guided in sliding guides 79. This adjusting element 78 can be used, for example, for interrupting the drive of the rollers 13 and 14 and/or for interrupting or reducing the suction effect of the suction device 19, 20 when a yarn breakage occurs without the necessity of additional electrical switching elements for these devices.

Figure 4:
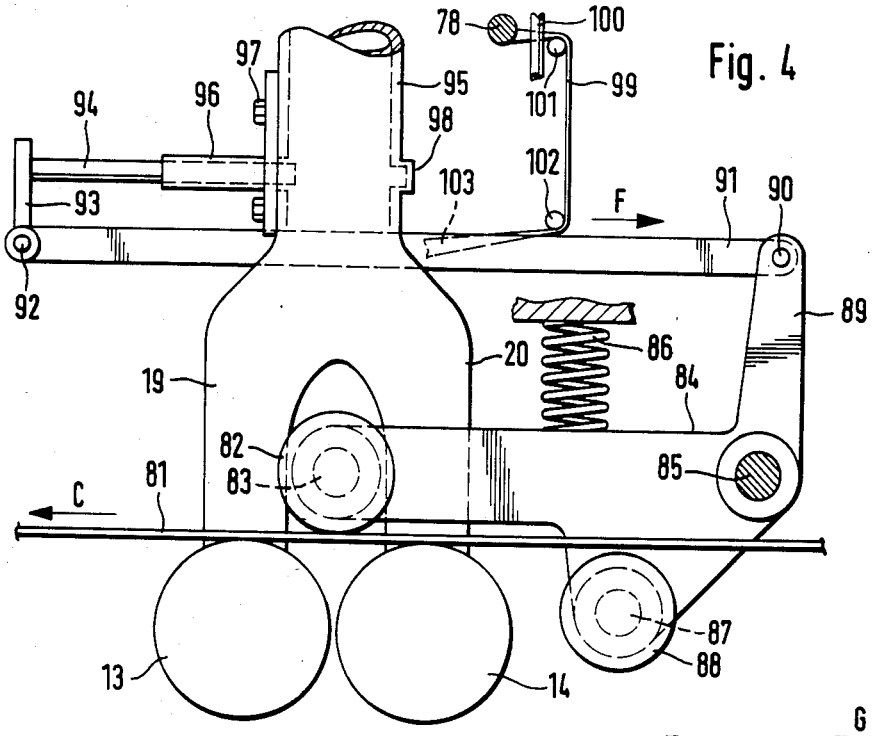
FIG. 4 is a partial view of a spinning unit in axial direction of the rollers.

In the case of the embodiment according to FIG. 4, a tangential belt 81 running along directly against the shell surfaces of the rollers 13 and 14 drives these rollers 13 and 14. The tangential belt 81 moves in the direction of the Arrow C in longitudinal direction of the machine and drives all rollers of all spinning aggregates 1 of at least one side of the machine. Each spinning unit 1 is equipped with a tension pulley 82 which presses the tangential belt 81 during the operation simultaneously against the shell surfaces of both rollers 13 and 14, so that the required friction forces occur. The tension roller 82 with one shaft 83 is freely rotatably disposed on an arm of a pivoted lever 84 which can be pivoted around a parallel stationary shaft 85 of the spinning unit 1. A pressure spring 86 loads the pivoted lever 84 in such a way that the tension pulley 82 is pressed against the tangential belt 81.

On the side of the tangential belt 81 that is opposite the tension pulley 82, a lift-off pulley 88 is provided at the pivoted lever 84, said lift-off pulley 88 being by means of a shaft 87 arranged freely rotatably on the arm of the pivoted lever 84. The lift-off pulley 88 has the purpose, during a pivotal movement of the pivoted lever 84, of detaching the tangential belt 81 from the shell surfaces of the rollers 13 and 14. If necessary, a brake that will rest against the rollers 13 and 14 may also be connected with the pivoted lever 84 so that at the time of the lifting off of the tangential belt 81 not only the drive is interrupted, but the rollers 13 and 14 are also braked. An arm 89 that extends approximately at a right angle to the tangential belt 81 and thus also to the connection of the tension pulley 82 and the lift-off pulley 88 is attached to the pivoted lever 84, an actuating rod 91 being linked to said arm 89 by means of a joint 90. The other end of the actuating rod 91 is linked, via a joint 92, to cam 93 of valve slide 94. The valve slide 94 is guided in a guide 96 and projects into a tube 95 which consists of the combination of the two suction pipes 19 and 20 leading to the rollers 13 and 14. The guide part 96, by means of screws 97, is fastened at the tube 95. The tube 95 also has a dwell 98 for the valve slide 94. In the embodiment shown, the dimensioning of the transmission elements and of the valve slide 94 is selected to be such that, in the case of an interruption of the drive of the rollers 13 and 14 by lifting off of the tangential belt 81, the valve slide 94 partially closes the tube 95. The effective vacuum in the suction devices 19 and 20 is thereby throttled. It is contemplated that the dimensions be selected to be such that the vacuum can be completely interrupted when the drive of the rollers 13 and 14 is interrupted.

The adjusting element 78 mentioned in regard to FIG. 3 that can be moved perpendicularly with respect to the plane of the drawing of FIG. 4, is linked to the actuating rod 91 at a point 103, via a tension member 99. The tension member 99, via several deflecting pulleys 100, 101 and 102 is guided in such a way that the movement of the adjusting element 78 taking place perpendicularly to the actuating rod 91 is transmitted into a movement extending in axial direction of the actuating rod 91. By an actuating of the pneumatic control member 64 corresponding to FIG. 3, the tension member 99 is loaded so that the actuating rod 91 is pulled in the direction of the Arrow F. As a result, the tangential belt 81 is lifted off the rollers 13 and 14, while simultaneously the effect of the suction device 10, 20 is reduced. Thus, in this embodiment, only one control element is required in order to lift off the wind-up spool 8 from the driving roller 9, disengage the drive of the rollers 13 and 14, and reduce the suction effect of the suction device 19, 20.

Figure 5:
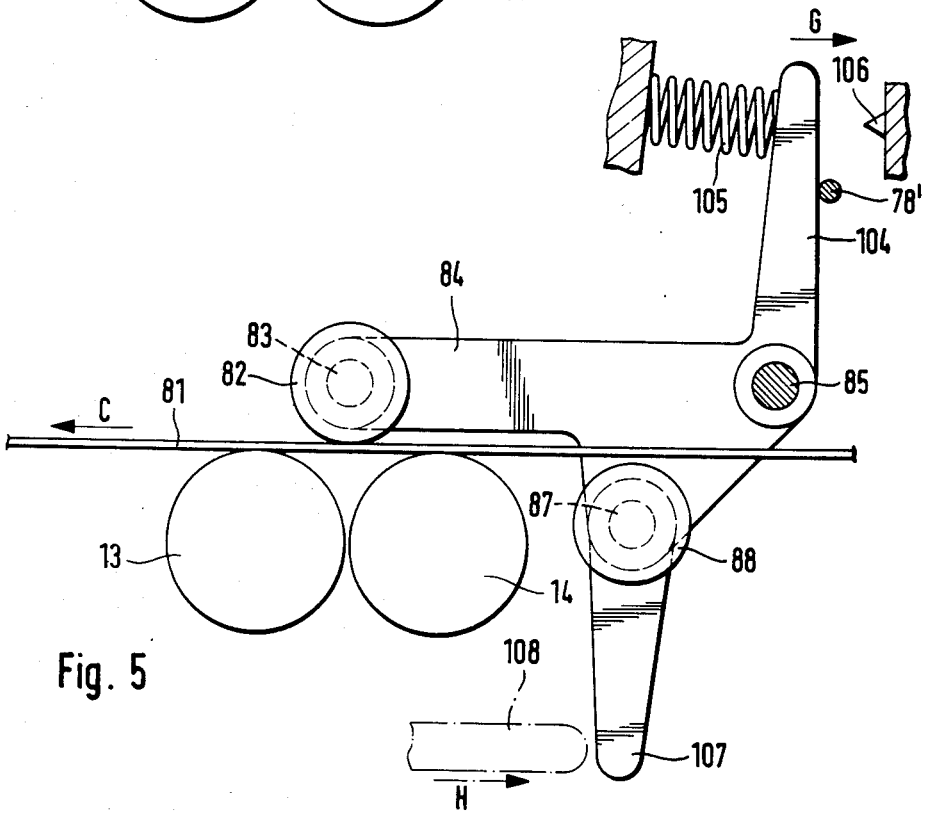
FIG. 5 is a partial view similar to that of FIG. 4 of another embodiment.

In the case of the embodiment according to FIG. 5, the rollers 13 and 14 are driven by a tangential belt 81 running against their shell surfaces and passing through in the direction C of the machine. By means of a tension pulley 82 arranged between the two rollers 13 and 14 and being freely rotatable around a shaft 83, the tangential belt 81 is pressed between the two rollers 13 and 14. The tension pulley 82 is arranged on a pivoted lever 84 which extends essentially in longitudinal direction the tangential belt 81 and can be pivoted around a stationary shaft 85. On the side of the tangential belt 81 that is opposite the tension pulley 82, a lift-off pulley 88 that is freely rotatable around a shaft 87 is mounted at the pivoted lever 84. The pivoted lever 84 is equipped with an arm 104 that is firmly connected and extends approximately at a right angle to the tangential belt 81. This arm 104, by means of a biasing spring 105, is pressed against the connecting element 78'. Element 78' acts as a locking element and is connected with the pneumatic control member 64 explained in FIG. 3.

When the control element 64 (FIG. 3) responds, the rod-shaped connecting element 78' is pulled out of contact with arm 104 so that the biasing spring 105 swivels the arm 104 in the direction of the Arrow G and presses it against a stop 106. In the process, the tension pulley 82 is moved away from the tangential belt 81 which simultaneously is lifted off the rollers 13 and 14 by the lift-off pulley 88. The connecting element 78' thus secures the operating position of the drive of the rollers 13 and 14 which, by means of a biasing member pressure spring 105, are separated from the tangential belt 81.

On the pivoted lever 84, an arm 107 is also mounted that projects out of the spinning unit 1 toward the operating side. Via said arm 107, the pivoted lever 84 and thus the tension pulley 82 and the lift-off pulley 88, can be returned to the operating position against the biasing force of the pressure spring 105. This takes place preferably by means of an actuating element 108 which is a component of an automatic servicing device and can be moved out against the arm 107 in the direction of the Arrow H.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. An open-end friction spinning apparatus having a plurality of spinning units, each said unit containing friction surface means forming a yarn formation zone for the formation of yarn, friction driving means for driving said friction surface means in said yarn formation zone, wind-up spool means for winding up formed yarn, spool driving means for driving said wind-up spool means and yarn guard means for sensing yarn breakage in said spinning unit, comprising:

automatic friction drive disengaging means at each said unit for disengaging said friction drive means from said friction surface means, and automatic spool drive disengaging means at each said unit for disengaging said spool driving means from said wind-up spool means, said automatic friction drive disengaging means and said automatic spool drive disengaging means being responsive to said yarn breakage sensed by said yarn guard means.

2. An open-end friction spinning apparatus according to claim 1, wherein said friction surface means comprises a pair of rollers arranged next to one another and said yarn formation zone comprises a wedge-shaped gap adjacent said rollers, said rollers being capable of being driven in the same rotational direction.

3. An apparatus according to claim 2, further comprising suction means adjacent said wedge-shaped gap for creating suction for holding fiber material and yarn in said wedge-shaped gap, and suction-interrupting means for reducing said suction, said suction-interrupting means being responsive to said yarn breakage sensed by said yarn guard means.

4. An open-end friction spinning apparatus according to claim 1, wherein said yarn guard means of each spinning unit is in direct communication with said spool drive disengaging means and said friction drive disengaging means.

5. An open-end friction spinning apparatus according to claim 2, wherein said yarn guard means of each spinning unit is in direct communication with said spool drive disengaging means and said friction drive disengaging means.

6. An open-end friction spinning apparatus according to claim 3, wherein said spool drive disengaging means, said friction drive disengaging means and said suction-interrupting means are in direct communication with said yarn guard means.

7. An open-end friction spinning apparatus according to claim 1, further comprising control means in communication with said yarn guard means, said control means controlling said spool drive disengaging means and said friction drive disengaging means.

8. An open-end friction spinning apparatus according to claim 2, further comprising control means in communication with said yarn guard means, said control means controlling said spool drive disengaging means and said friction drive disengagihg means.

9. An open-end friction spinning apparatus according to claim 3, wherein each spinning unit contains control means in direct communication with said yarn guard means, said control means controlling said spool drive disengaging means, said friction drive disengaging means and said suction-interrupting means.

10. An open-end friction spinning apparatus according to claim 1, wherein said spool drive disengaging means is connected to said friction drive disengaging means.

11. An open-end friction spinning apparatus according to claim 2, wherein said spool drive disengaging means is connected to said friction drive disengaging means.

12. An open-end friction spinning apparatus according to claim 10, wherein said spool drive disengaging means and said friction drive disengaging means are connected by a mechanical connecting means.

13. An open-end friction spinning apparatus according to claim 11, wherein said spool drive disengaging means and said friction drive disengaging means are connected by a mechanical connecting means.

14. An open-end friction spinning apparatus according to claim 3, wherein said spool drive disengaging means is connected with said friction drive disengaging means and said suction-interrupting means.

15. An open-end friction spinning apparatus according to claim 14, wherein said spool drive disengaging means is connected with said friction drive disengaging means and said suction-interrupting means by mechanical connecting means.

16. An open-end friction spinning apparatus according to claim 12, wherein said mechanical connecting means includes locking means for releasably locking said friction drive disengaging means in an inoperative position.

17. An open-end friction spinning apparatus according to claim 15, wherein said mechanical connecting means includes locking means for releasably locking said friction drive disengaging means in an inoperative position.

18. An open-end friction spinning apparatus according to claim 16, wherein said friction drive disengaging means is spring-biased in an operative position.

19. An open-end friction spinning apparatus according to claim 17, wherein said friction drive disengaging means is spring-biased in an operative position.

20. An open-end friction spinning apparatus according to claim 1, wherein said spool drive disengaging means comprises spool holder means for supporting said spool means, said spool holder means being connected to actuating drive means responsive to said yarn breakage sensed by said yarn guard means.

21. An open-end friction spinning apparatus according to claim 2, wherein said spool drive disengaging means comprises spool holder means for supporting said spool means, said spool holder means being connected to actuating drive means responsive to said yarn breakage sensed by said yarn guard means.

22. A method of open-end friction spinning comprising:

feeding fiber to a yarn formation zone formed by friction surface means driven by driving means, forming yarn from said fiber in said yarn formation zone, withdrawing said yarn from said yarn formation zone, sensing yarn breakage after withdrawing said yarn from said yarn formation zone, and winding up said yarn on a wind-up device driven by spool driving means, disengaging said friction driving means and said spool driving means in response to sensing of said yarn breakage.

23. A method according to claim 22, wherein said yarn formation zone comprises a wedge-shaped gap and said friction surface means comprises a pair of rollers arranged next to one another.

24. An open-end friction spinning apparatus having a plurality of spinning units, each said unit containing friction surface means forming a yarn formation zone for the formation of yarn, friction driving means for driving said friction surface meana in said yarn formation zone, wind-up spool means for winding up formed yarn, spool driving means for driving said wind-up spool means and yarn guard means for sensing yarn breakage in said spinning unit, comprising:

friction drive disengaging means for disengaging said friction drive means from said friction surface means, spool drive disengaging means for disengaging said spool driving means from said wind-up spool means, said friction drive disengaging means and said spool disengaging means being responsive to said yarn breakage sensed by said yarn guard means, said friction surface means comprising a pair of rollers arranged next to one another, said yarn formation zone comprising a wedge-shaped gap adjacent said rollers, said rollers being capable of being driven in the same rotational direction, suction means adjacent said wedge-shaped gap for creating suction for holding fiber material and yarn in said wedge-shaped gap, and suction-interrupting means for reducing said suction, said suction-interrupting means being responsive to said yarn breakage sensed by said yarn guard means, said spool drive disengaging means being connected with said friction drive disengaging means and aid suction-interrupting means, said spool drive disengaging means being connected with said friction drive disengaging means and said suction-interrupting interrupting means by mechanical means, said mechanical connecting means including locking means for releasably locking said friction drive disengaging means in an inoperative position.

25. An open-end friction spinning apparatus having a plurality of spinning units, each said unit containing friction surface means forming a yarn formation zone for the formation of yarn, friction driving means for driving said friction surface means in said yarn formation zone, wind-up spool means for winding up formed yarn, spool driving means for driving said wind-up spool means and yarn guard means for sensing yarn breakage in said spinning unit, comprising:

friction drive disengaging means for disengaging said friction drive means from said friction surface means, and spool drive disengaging means for disengaging said spool driving means from said wind-up spool means, said friction drive disengaging means and said spool disengaging means being responsive to said yarn breakage sensed by said yarn guard means, said spool drive disengaging means being connected to said friction drive disengaging means, said spool drive disengaging means and said friction drive disengaging means being connected by a mechanical connecting means, said mechanical connecting means including locking means for releasably locking said friction drive disengaging means in an operative position, said friction drive disengaging means being spring-biased in an operative position.

26. An open-end friction spinning apparatus according to claim 24, wherein said friction drive disengaging means is spring-biased in an operative position.

* * * * *